US010866547B2

(12) United States Patent
Takagi

(10) Patent No.: US 10,866,547 B2
(45) Date of Patent: Dec. 15, 2020

(54) HEATER HAVING A GLASS LAYER PROVIDED ON AN OPPOSITE SURFACE OF A SUBSTRATE FROM A SURFACE ON WHICH A HEATING ELEMENT IS PROVIDED, IMAGE HEATING APPARATUS MOUNTED WITH THE SAME, AND IMAGE FORMING APPARATUS

(71) Applicant: CANON KABUSHIKI KAISHA, Tokyo (JP)

(72) Inventor: Kenji Takagi, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/545,718

(22) Filed: Aug. 20, 2019

(65) Prior Publication Data

US 2020/0064762 A1 Feb. 27, 2020

(30) Foreign Application Priority Data

Aug. 21, 2018 (JP) ..... 2018-154609

(51) Int. Cl.
*G03G 15/20* (2006.01)

(52) U.S. Cl.
CPC ..... *G03G 15/2053* (2013.01); *G03G 15/2028* (2013.01)

(58) Field of Classification Search
CPC ..... G03G 15/2053; G03G 15/2028
See application file for complete search history.

(56) References Cited

U.S. PATENT DOCUMENTS

| | | | | |
|---|---|---|---|---|
| 7,599,637 | B2 | 10/2009 | Nanataki et al. | |
| 7,865,102 | B2 | 1/2011 | Nanataki et al. | |
| 8,229,338 | B2 | 7/2012 | Nanataki et al. | |
| 8,977,176 | B2 | 3/2015 | Shimizu et al. | |
| 10,303,095 | B2 | 5/2019 | Takagi et al. | |
| 2018/0196378 | A1* | 7/2018 | Takagi | G03G 15/2028 |
| 2019/0041780 | A1 | 2/2019 | Takagi | |

FOREIGN PATENT DOCUMENTS

| | | | |
|---|---|---|---|
| JP | 10-133502 | A | 5/1998 |
| JP | 2006-092785 | A | 4/2006 |
| JP | 2008032817 | A * | 2/2008 |

* cited by examiner

*Primary Examiner* — Susan S Lee
(74) *Attorney, Agent, or Firm* — Venable LLP

(57) ABSTRACT

A heater being used in an image heating apparatus includes a glass layer formed on one surface of a substrate of the heater, the heater has a base layer formed so as to extend in a longitudinal direction of the substrate between another surface of the substrate and the glass layer and at a position closer to an end side of the substrate than a center position of a heating element provided on the other surface of the substrate in a transverse direction that is orthogonal to the longitudinal direction of the substrate, the base layer having a glass content of 10 wt % or lower, and a peak portion with a peak height from the other surface in the glass layer is positioned within 1.0 mm from an end in the transverse direction of the substrate.

16 Claims, 11 Drawing Sheets

HEATER HAVING A GLASS LAYER PROVIDED ON AN OPPOSITE SURFACE OF A SUBSTRATE FROM A SURFACE ON WHICH A HEATING ELEMENT IS PROVIDED, IMAGE HEATING APPARATUS MOUNTED WITH THE SAME, AND IMAGE FORMING APPARATUS

BACKGROUND OF THE INVENTION

Field of the Invention

The present invention relates to image heating apparatuses such as a fixing unit mounted to an image forming apparatus using an electrophotographic system or an electrostatic recording system and a gloss imparting apparatus which reheats a toner image fixed to a recording material in order to improve a gloss value of the toner image. The present invention also relates to image forming apparatuses such as a copier, a printer, a fax, or a multifunction machine equipped with a plurality of these functions which are equipped with the image heating apparatus.

Description of the Related Art

Among the image heating apparatus described above, image heating apparatuses adopting a film heating system which has high thermal responsiveness and which is suitable for quick start are being proposed and put to practical use (Japanese Patent Application Laid-open No. H10-133502, Japanese Patent Application Laid-open No. 2006-92785).

FIG. 11A is a schematic sectional view showing a schematic configuration of a conventional image heating apparatus 110 adopting a film heating system. The image heating apparatus 110 includes a heating body (hereinafter, referred to as a heater) 500 as a heating member, a heat-resistant thin film 121, a film guide 123 which guides rotation of the film 121, and an elastic pressure roller 130 which comes into pressure contact with an outer surface of the film 121. The film guide 123 is, for example, a member made of heat-resistant plastic, and also serves as a heater supporter for fixing and supporting the heater 500. The elastic pressure roller 130 is brought into pressure contact with a prescribed pressing force with respect to the heater 500 via the film 121 sandwiched between the elastic pressure roller 130 and the heater 500, the heater 500 being fixed to and supported by a lower surface of the film guide 123. Accordingly, a nip portion (hereinafter, referred to as a fixing nip portion) N with a prescribed width is formed between the film 121 and the elastic pressure roller 130. The film 121 having a cylindrical shape is transported and moved in a direction depicted by an arrow in a state where a film inner surface is in close contact with and slides against a lower surface of the heater 500 at the fixing nip portion N due to a rotative force of driving means (not illustrated) or the elastic pressure roller 130.

In a state where the film 121 has been transported and moved and the heater 500 has been heated and regulated to a prescribed temperature, a recording material M on which is formed and which bears an unfixed toner image t as a heated material is fed to the fixing nip portion N between the film 121 and the elastic pressure roller 130. The recording material M is fed to the fixing nip portion N with an image bearing surface side facing a fixing film side, and the image bearing surface side comes into close contact with an outer surface of the film 121 at the fixing nip portion N and sandwiches and transports the fixing nip portion N together with the film 121. In the fixing nip portion N, the recording material M and the toner image t are heated via the film 121 by heat of the heater 500 and the toner image t is heated and fixed to the recording material M. The film 121 is constituted by a base layer and a releasable layer, and the film base layer side is on a side of the heater 500 (a cylinder inner surface side) while the releasable layer is on a side of the pressure roller 130 (a cylinder outer surface side). The film base layer is formed by a high-rigidity, highly heat-resistant resin, and the releasable layer is a toner offset prevention layer of the film 121 and is formed with a fluorine resin coating.

FIG. 11B is a schematic sectional view of the heater 500 as the heating member, the heater 500 being a ceramic heater which uses a ceramic substrate with an electrical insulation property, good heat conductance, and a low heat capacity as a substrate 501. A resistance heating layer (a heating element) 502 is formed and provided along a longitudinal direction of the substrate 501 on a back surface side (an opposite side to a side opposing the film 121) of the heater 500. A resistance heating layer-formed surface of the substrate 501 is covered by a glass protective layer 503 in order to ensure that the substrate 501 is insulated. In addition, a sliding surface glass 505 is provided on a front surface side of the substrate 501 in order to prevent the substrate 501 from abrasion and damage due to the film 121 being in close contact with and sliding against the substrate 501.

As shown in FIG. 11A, a temperature detecting member (a thermistor) 124 is disposed on the back surface side of the ceramic substrate 501, and the temperature detecting member 124 controls energization of the resistance heating layer 502 so as to keep the resistance heating layer 502 at a prescribed temperature.

As described above, the image heating apparatus 110 adopting a film heating system includes the low-heat capacity heater 500 capable of rapid heating as a heating member and the low-heat capacity thin film 121. Since the substrate 501 of the heater 500 has high heat conductance, forming the resistance heating layer 502 on the back surface side enables a thickness of the sliding surface glass 505 on the front surface side to be minimized and enables heat conductance to the film 121 to be further increased. Accordingly, quick start of the image heating apparatus and the image forming apparatus can be realized.

SUMMARY OF THE INVENTION

However, reducing the thickness of the glass 505 on the sliding surface side for the purpose of ensuring heat conductance as described above creates a risk that the inner surface of the film 121 may wear down due to rubbing against an end of the substrate 501 which is not coated by the glass 505 and, consequently, the film 121 may become damaged. On the other hand, increasing the thickness of the glass 505 on the sliding surface side creates a risk that heat conductance from the heater 500 to the film 121 may decline and, consequently, delays may be imposed on quick start, FPOT (First Print Out Time), and the like.

In addition, in the heating apparatus adopting a film heating system according to Japanese Patent Application Laid-open No. 2006-92785, rubbing against a film is suppressed by coating an end ridge portion of the substrate with glass. However, a configuration in which the end ridge portion (a vicinity of an end) of the substrate is coated with glass is difficult to adopt when a method of manufacturing a heater is taken into consideration. Conventionally, a ceramic heater used in an image forming apparatus is manufactured by dividing a single mother plate with a certain size into a plurality of substrates. Specifically, in a state where cut portions such as perforations are provided in advance on the single mother plate by a diamond cutter or the like, heating elements, conductors, and electrode patterns are printed by screen printing, and after coating the mother plate with an overcoat glass and subjecting the mother plate to heating and baking, the mother plate is divided into a plurality of heaters. Coating the end ridge portion of the substrate with glass poses a problem in terms of mass productivity because the need to form the overcoat glass after the substrate dividing process makes it necessary to correct a position for each substrate and complicates the manufacturing process.

An object of the present invention is to provide a technique which enables abrasion of a film due to rubbing between an end of a substrate of a heater and a film inner surface to be suppressed while maintaining high mass productivity.

In order to achieve the object described above, a heater according to the present invention, being used in an image heating apparatus which heats an image formed on a recording material, includes:

a substrate;

a heating element provided on one surface of the substrate; and a glass layer formed on the other surface of the substrate opposite from the one surface, wherein the heater has a base layer formed so as to extend along a longitudinal direction of the substrate between the other surface and the glass layer and at a position closer to an end side of the substrate than a center position of the heating element in a transverse direction that is orthogonal to the longitudinal direction of the substrate, wherein the glass layer is provided for protecting the base layer, wherein the base layer has a glass content of 10 wt % or lower, and wherein a peak portion with a peak height from the other surface in the glass layer is positioned within 1.0 mm from an end in the transverse direction of the substrate.

In order to achieve the object described above, a heater according to the present invention, being used in an image heating apparatus which heats an image formed on a recording material, includes:

a substrate;

a heating element provided on one surface of the substrate; and a glass layer formed on the other surface of the substrate opposite from the one surface, wherein the glass layer has a protruding portion that protrudes further than an end of the substrate in a transverse direction that is orthogonal to a longitudinal direction of the substrate, and wherein the protruding portion has a maximum height from the other surface at a position closer to an end side of the substrate than a center position of the heating element in a transverse direction.

In order to achieve the object described above, an image heating apparatus according to the present invention includes:

the heater according to the present invention;

a cylindrical film having an inner surface with which the heater comes into contact;

a film guide portion which guides the inner surface of the film; and a rotating member which comes into contact with an outer surface of the film so as to form a nip portion for sandwiching and transporting a recording material between the outer surface of the film and the rotating member, wherein the apparatus heats an image formed on the recording material using heat of the heater.

In order to achieve the object described above, an image forming apparatus according to the present invention includes:

an image forming portion which forms an image on a recording material; and a fixing portion which fixes an image formed on the recording material to the recording material, wherein the fixing portion is the image heating apparatus according to the present invention.

According to the present invention, abrasion of a film due to rubbing between an end of a substrate of a heater and a film inner surface can be suppressed while maintaining high mass productivity.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 1:
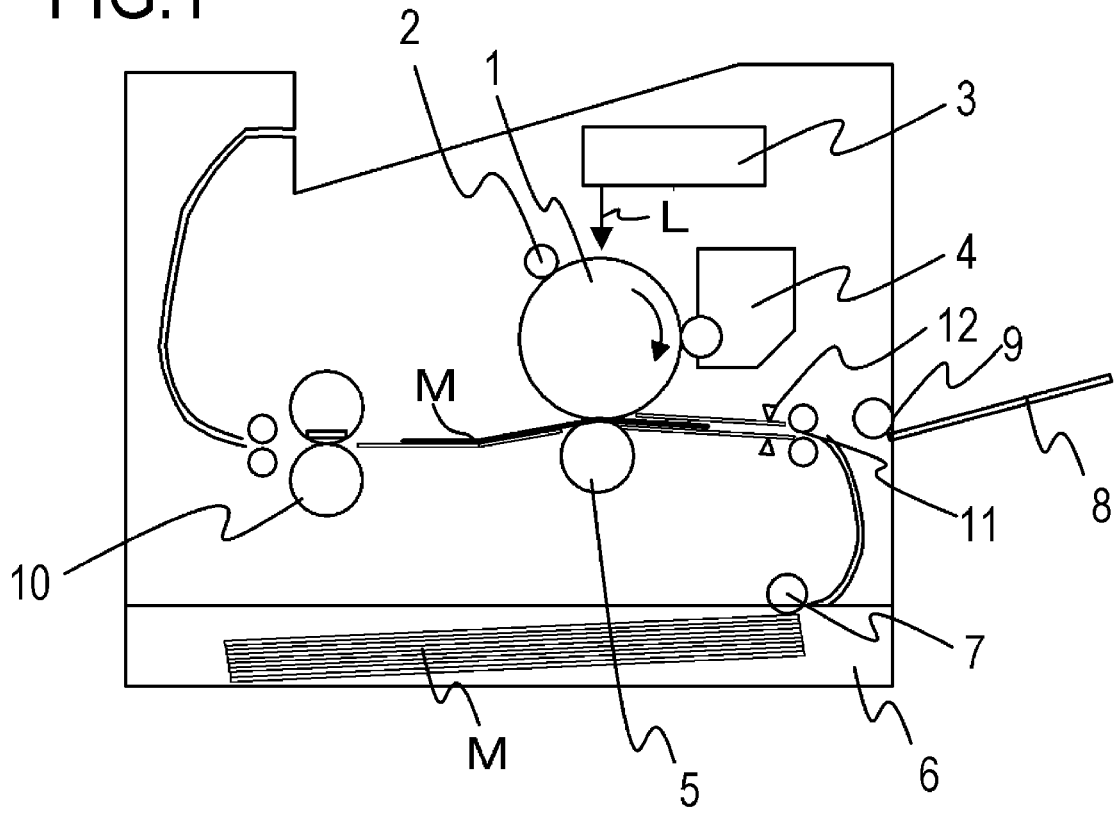
FIG. 1 is a schematic configuration diagram of an image forming apparatus (a laser printer) according to an embodiment of the present invention.

FIG. 1 is a schematic configuration diagram of a laser beam printer (hereinafter, referred to as a laser printer) as an image forming apparatus according to an embodiment of the present invention. Examples of image forming apparatuses to which the present invention is applicable include copiers, printers, faxes, and multifunction machines equipped with a plurality of these functions which utilize an electrophotographic system or an electrostatic recording system.

A photosensitive drum 1 is rotationally driven in a direction depicted by an arrow, and a surface of the photosensitive drum 1 is uniformly charged by a charging roller 2 as a charging apparatus. Next, scanning exposure by a laser beam L of which ON/OFF is controlled in accordance with image information by a laser scanner 3 is performed and an electrostatic latent image is formed (a latent image forming process). In addition, a developing apparatus 4 causes toner to adhere to the electrostatic latent image and develops a toner image on the photosensitive drum 1 (a developing process). Subsequently, the toner image formed on the photosensitive drum 1 is transferred at a transfer nip portion which is a pressure contact portion between a transfer roller 5 and the photosensitive drum 1 to a recording material M which is a heated member having been transported by a paper feeding roller 7 at a prescribed timing from a paper feeding cassette 6 (a transfer process). At this point, the timing is adjusted by detecting a leading end of the recording material transported by a transporting roller 11 by a top sensor 12 so that an image formation position of the toner image on the photosensitive drum 1 and a write start position of the leading end of the recording material M match each other. The recording material M having been transported to the transfer nip portion at a prescribed timing is sandwiched and transported by the photosensitive drum 1 and the transfer roller 5 by a constant pressurizing force. The configuration up to the formation of an unfixed toner image on the recording material M described above corresponds to the image forming portion in the image forming apparatus according to the present invention. The recording material M to which the unfixed toner image has been transferred is transported to a heating apparatus (an image heating apparatus) 10 as a fixing portion (an image heating portion) where the toner image is heated and fixed to the recording material by the heating apparatus 10. Subsequently, the recording material M is discharged onto a paper discharge tray. It should be noted that, in some cases, the recording material M is fed into the machine by a transporting roller 9 from a manual feeding tray 8.

Figure 2A:
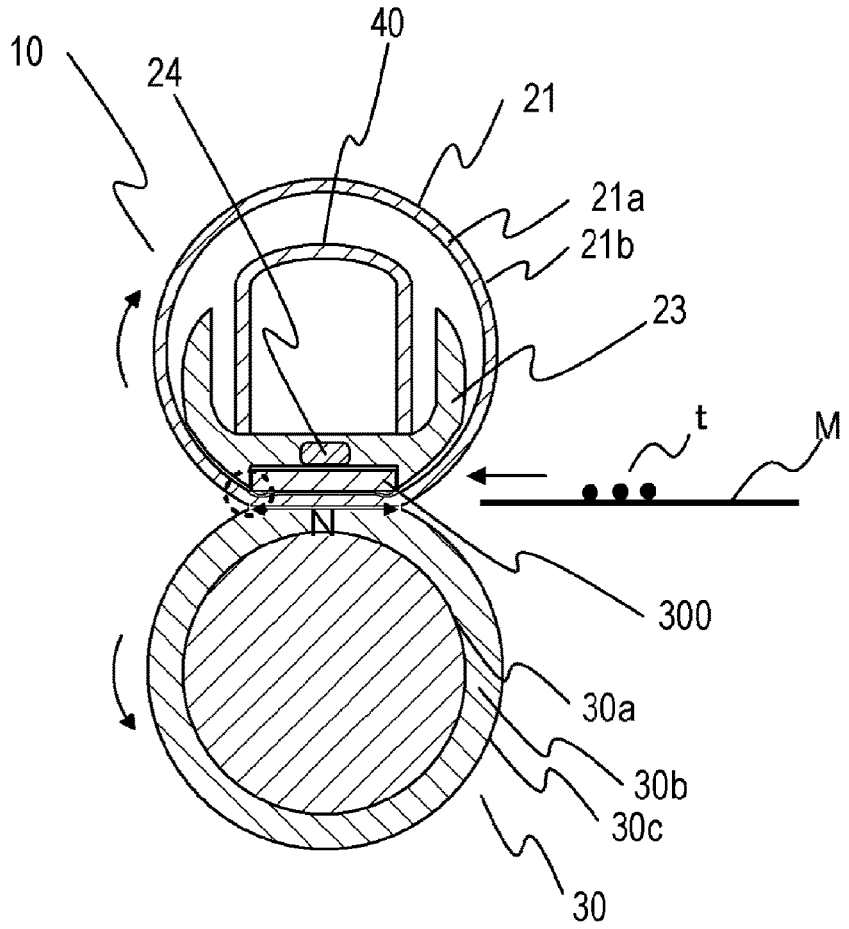
FIGS. 2A and 2B are schematic configuration diagrams of an image heating apparatus according to the present embodiment.

The heating apparatus 10 according to the present embodiment will be described with reference to FIGS. 2A and 2B. FIG. 2A is a schematic configuration diagram of the heating apparatus 10. The heating apparatus includes a cylindrical film 21 which is an endless belt, a heater 300 in contact with an inner surface of the film 21, and a pressure roller 30 as a pressure rotating member (a pressing member) which forms a fixing nip portion N together with the heater 300 via the film 21.

The film 21 has a base layer 21*a* and a releasing layer 21*b* formed on an outer side of the base layer. The base layer 21*a* is formed of a heat-resistant resin such as polyimide, polyamide-imide, or PEEK or a metal such as SUS. In the present embodiment, polyimide that is a heat-resistant resin with a thickness of 65 μm is used. As a rigidity of the polyimide according to the present embodiment, the polyimide has a Young's modulus of 6300 MPa. The releasing layer 21*b* is formed by applying, either in a mixture or independently, a coat of a heat-resistant resin with favorable releasability including a fluorine resin such as PTFE, PFA, or FEP of a silicone resin. In the present embodiment, the coat is 15 μm-thick PFA (a fluorine resin). The film 21 according to the present embodiment has a length of 240 mm in a longitudinal direction and an outer diameter of 24 mm.

A film guide 23 is a guiding member when the film 21 rotates as a film guide portion of the image heating apparatus, and the film 21 is loosely fitted to an outer side of the film guide 23. In addition, the film guide 23 also serves as a heater supporter that supports the heater 300 in the image heating apparatus. The film guide 23 is formed by a liquid crystal polymer or a heat-resistant such as a phenolic resin, PPS, or PEEK.

The pressure roller 30 has a core metal 30*a*, an elastic layer 30*b* formed on an outer side of the core metal, and a releasable layer 30*c*, and the releasable layer 30*c* comes into contact with an outer surface of the releasing layer 21*b* of the film 21 to form the fixing nip portion N. The core metal 30*a* is formed by a metal such as SUS, SUM, or Al. The elastic layer 30*b* is formed by a heat-resistant rubber such as silicone rubber or fluororubber or by a product of foam formation of silicone rubber. The releasable layer 30*c* provided on an outer side of the elastic layer 30*b* is formed by 50 μm-thick PFA that is a fluorine resin. The pressure roller 30 according to the present embodiment has an outer diameter of 25 mm, and the elastic layer 30*b* is formed by 3.5 mm-thick silicone rubber. In addition, a length of the elastic layer 30*b* in a longitudinal direction in the pressure roller 30 is 230 mm.

A stay 40 is a member for applying pressure of a spring (not illustrated) to the film guide 23 in a direction of the pressure roller 30 to form the fixing nip portion N for heating and fixing toner on the recording material M, and a metal with high rigidity is used as the stay 40.

In addition, the pressure roller 30 rotates as a driving force is transmitted from a driving source (not illustrated) to a gear (not illustrated) provided at an end in a longitudinal direction of the core metal 30*a*. The film 21 rotates so as to follow the pressure roller 30 due to a friction force received from the pressure roller 30 in the fixing nip portion N. A thermistor 24 as a temperature detecting element of the heater 300 is in contact with a back surface side (a surface on an opposite side to a surface that comes into contact with the film 21) of the heater 300.

Figure 2B:
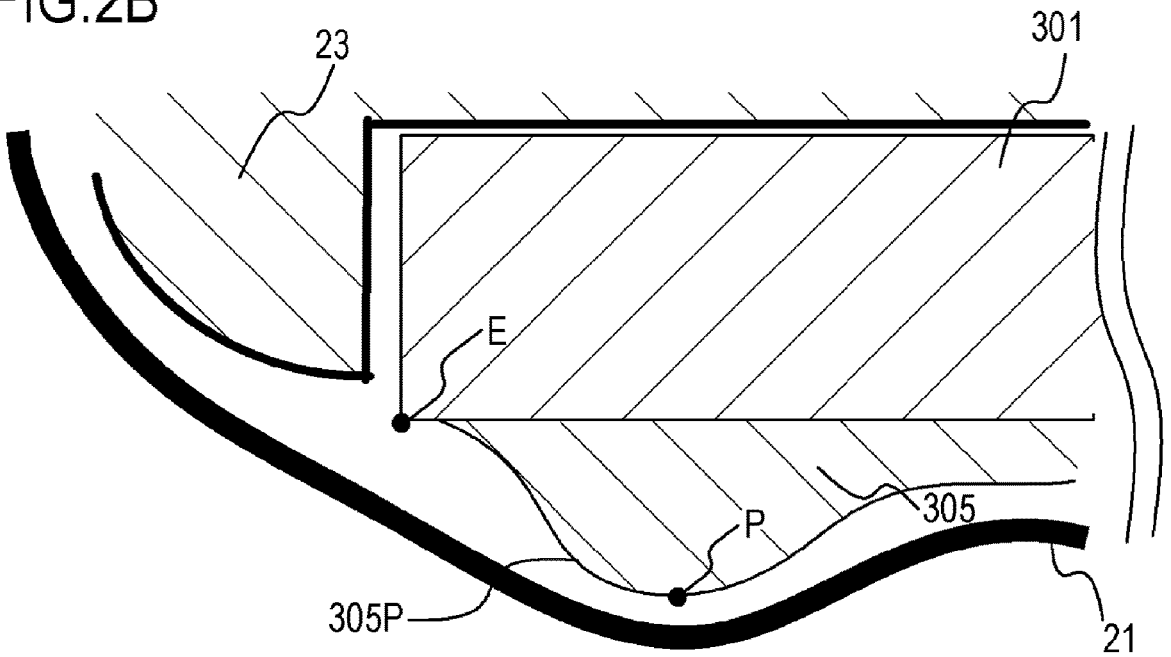

FIG. 2B is a schematic sectional view of an enlargement of a downstream side (a region enclosed by a dash line in FIG. 2A) in a transportation direction of the recording material M of the fixing nip portion N of the heating apparatus 10. In the present embodiment, an upstream side of a peripheral configuration of the fixing nip portion N is symmetrical to the downstream side and an illustration thereof will be omitted.

By a manufacturing method to be described later, the heater 300 according to the present embodiment is provided with a protruding portion 305P at a position that is as close as possible to a heater edge E which is on an end side of a substrate 301 of the heater 300 and which is not glass-coated in an overcoat glass 305 on a sliding surface side. The protruding portion 305P is a portion that protrudes in a direction orthogonal to another surface of the substrate 301 in the overcoat glass 305 and has a glass peak portion P having a maximum height from the other surface. The protruding portion 305P protrudes further toward an inner surface of the film 21 than the heater edge E so as to support the inner surface of the film 21 between the protruding portion 305P and the film guide 23 positioned on an opposite side with respect to the heater edge E. Having the film guide 23 and the protruding portion 305P support the inner surface of the film 21 prevents the heater edge E from coming into sliding contact with the inner surface of the film 21.

Figure 3A:
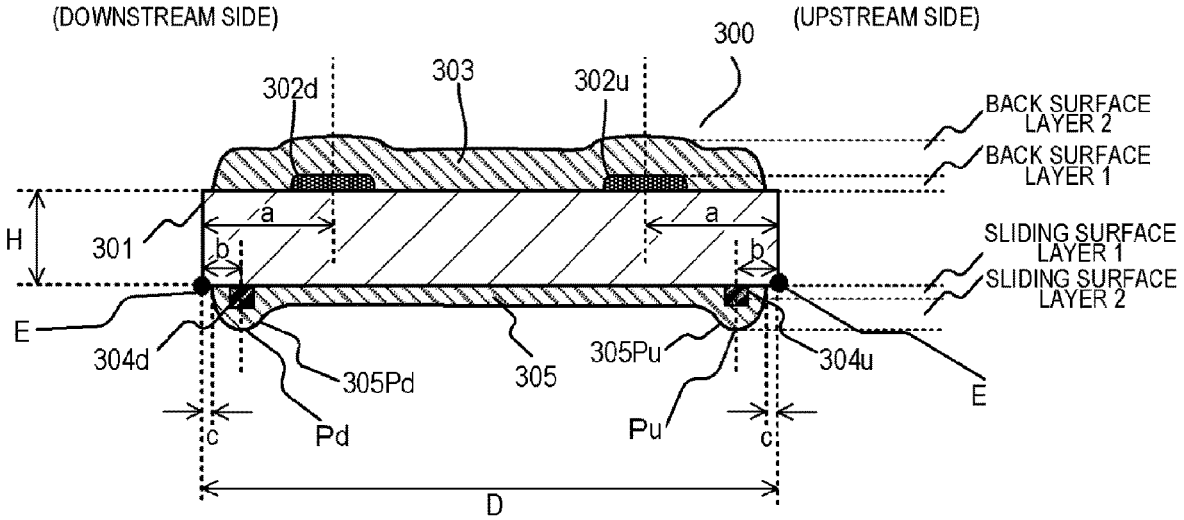
FIGS. 3A to 3E are schematic views showing a shape of a heater according to a first embodiment.

FIGS. 3A to 3E are schematic views illustrating a configuration of the heater 300 which is a feature of the present embodiment. The heater 300 has a rectangular parallelepiped shape that is thin and elongated in one direction, and FIG. 3A is a schematic sectional view at a center position in a longitudinal direction of the heater 300 (a direction orthogonal to the transportation direction of the recording material M, a longitudinal direction of the substrate 301).

Resistance heating elements 302 which generate heat when energized are provided on a surface (one surface) of the substrate 301 on the back surface side of the heater 300, and the resistance heating elements 302 are covered by an overcoat glass 303 as a protective layer. A resistance heating element on an upstream side in the recording material transportation direction when mounting to the heating apparatus 10 will be denoted by 302*u* and a recording material on a downstream side will be denoted by 302*d*. The substrate 301 contains $Al_2O_3$ with an electrical insulation property, low heat capacity, and favorable heat conductance as a main component and has a thickness H of 0.6 mm and a transverse width W of 9.0 mm. The resistance heating elements 302 contain silver-palladium (Ag/Pb) and glass as main components and are formed to a thickness of 10 μm by screen printing. The overcoat glass 303 has an electrical insulation property and has a thickness of 60 μm.

A base layer 304 is provided on a surface (the other surface) of the substrate 301 on a front surface side of the heater 300, and the base layer 304 is covered by an overcoat glass 305 as a protective layer. The base layer 304 contains silver-palladium (Ag/Pb) and glass as main components and is formed to a thickness of 5 μm by screen printing. While silver or a silver-palladium alloy is suitable as a material of the base layer 304, the material of the base layer 304 is not limited thereto. The overcoat glass 305 is imparted with high smoothness in order to ensure favorable slidability with the film 21, and a thickness of the overcoat glass 305 is set to 30 μm in consideration of heat conductance. In this case, from the perspective of heat conductance, since reducing the thickness of the overcoat glass 305 enables more heat of the resistance heating elements 302 to be transmitted to the film 21, quick start of the heating apparatus 10 can be performed and FPOT of the image forming apparatus can be reduced.

Figure 3B:
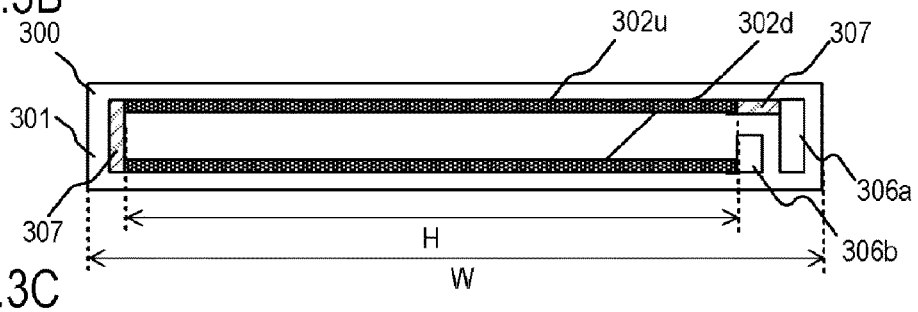

FIG. 3B is a plan view showing a configuration of a back surface layer 1 of the heater 300, in which a circuit for causing the resistance heating elements 302 to generate heat is constituted by electrode portions 306, the resistance heating elements 302, and conductors 307. The resistance heating elements 302 generate heat when prescribed voltage is applied between the electrode portions 306*a* and 306*b* from energization control means (not illustrated). The present embodiment adopts an electric circuit configuration diagram in which a heater resistance is 10Ω, applied voltage is 100 V, and a maximum of 1000 W can be applied. A longitudinal width H of the resistance heating elements 302 is set to 220 mm in order to accommodate a maximum width 216 mm (longitudinal feed of LTR size) of recording materials that can be accommodated by the image forming apparatus according to the present embodiment. A longitudinal width W of the substrate 301 is 240 mm.

Figure 3C:
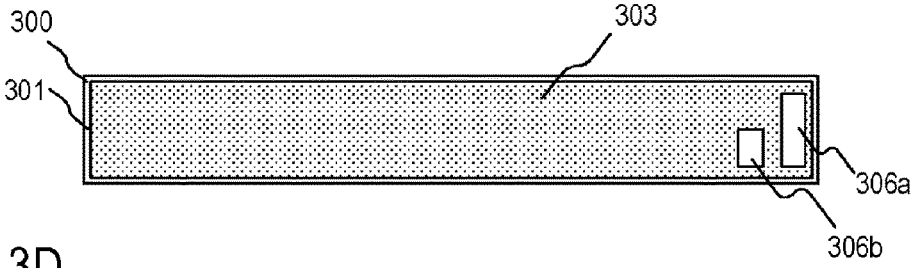

FIG. 3C is a plan view showing a configuration of a back surface layer 2 of the heater 300. The overcoat glass 303 is formed over almost an entire region of the substrate 301 with the exception of a ridge portion of the heater edge E (a vicinity of an end edge of one surface of the substrate 301) so as to cover the resistance heating elements 302 and the conductors 307. It should be noted that the electrode portions 306 are not covered by the overcoat glass 303 and are exposed.

Figure 3D:
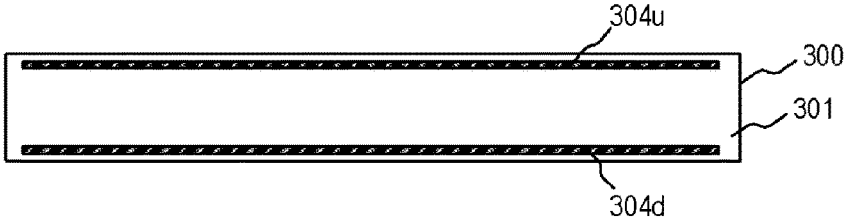

FIG. 3D is a plan view showing a configuration of a sliding surface layer 1 of the heater 300, the sliding surface layer 1 being formed such that the base layer 304 uniformly extends in the longitudinal direction of the substrate 301 in a vicinity of an end in the longitudinal direction. A base layer on an upstream side when mounting to the heating apparatus 10 will be denoted by 304*u* and a base layer on a downstream side will be denoted by 304*d*.

Figure 3E:
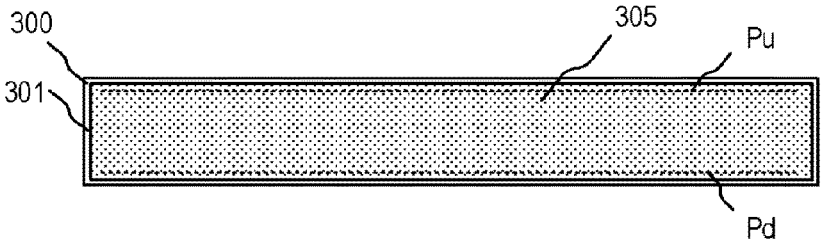

FIG. 3E is a plan view showing a configuration of a sliding surface layer 2 of the heater 300, in which the overcoat glass 305 is formed over almost an entire region of the substrate 301 with the exception of a ridge portion of the heater edge E (a vicinity of an end edge of the other surface of the substrate 301). In this case, the overcoat glass 305 has glass peak portions P of which a height from the other surface of the substrate 301 is maximized, and a glass peak portion of a protruding portion 305Pu on an upstream side when mounting to the heating apparatus 10 will be denoted by Pu and a glass peak portion of a protruding portion 305Pd on a downstream side will be denoted by Pd.

The base layer 304 is provided on an inner side (a center side) of a surface of the substrate 301 by a prescribed distance from an end in a transverse direction (a width direction orthogonal to the longitudinal direction) of the substrate 301. Accordingly, in the transverse direction of the substrate 301, a position where the glass peak portion p is formed and a position (a center position) of the base layer 304 approximately match each other. In the present embodiment, a distance b from an end of the substrate 301 to the center position of the base layer 304 in the transverse direction of the substrate 301 is set to 0.8 mm.

In addition, on the back surface side of the heater 300, a distance a from an end of the substrate 301 to a center position of the resistance heating element 302 in the transverse direction of the substrate 301 is set to 2.2 mm, and a position of the resistance heating element 302 in the transverse direction is set so as to differ from those of the base layer 304 and the glass peak portion P. Accordingly, the overcoat glass 305 on the sliding surface side at a same position in the transverse direction can be formed so as to have a reduced thickness with respect to the resistance heating element 302 on the back surface side of the heater 300. As a result, heat generated by the resistance heating element 302 on the back surface side of the heater 300 can be more efficiently transmitted to the sliding surface side.

A manufacturing process of the heater 300 will now be described.

Step 1

Figure 4:
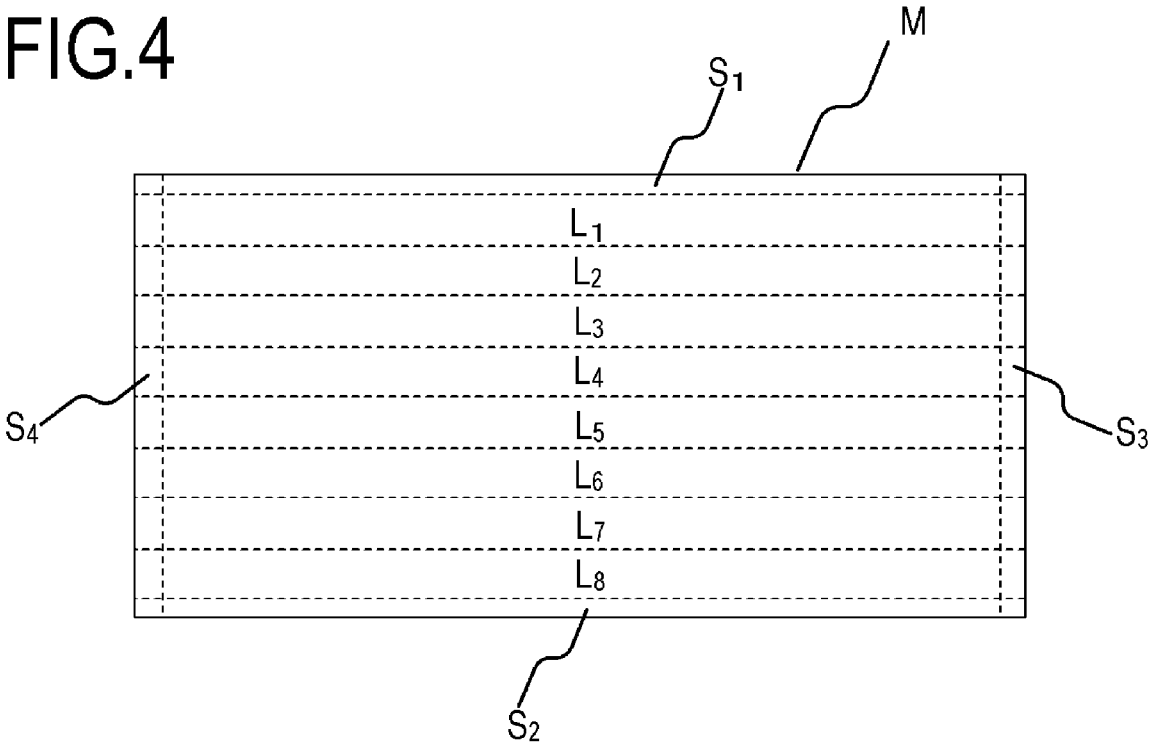
FIG. 4 is a front view showing a mother plate of a substrate.

On a mother plate M (length 250 mm, width 80 mm, and thickness 0.6 mm) of the substrate 301 shown in FIG. 4, scribe lines are formed to a depth of approximately 10 to 50 μm by relatively moving a diamond cutter 20 while pressing the diamond cutter 20 against locations of dotted line portions. Each of $L_1$ to $L_8$ on the mother plate M corresponds to the substrate 301 of the heater 300, and the scribe lines are lines used to divide the mother plate M after forming resistance heating elements, overcoat glasses, and the like. Eight heaters 300 can be manufactured from one mother plate M. Peripheral portions $S_1$ to $S_4$ are margin portions.

Step 2

Patterns on the heater 300 are formed by repeating a film forming process by screen printing and a high-temperature baking process for each layer and each material paste. Specifically, layers are formed in an order of the back surface layer 1 (the resistance heating elements 302, the conductors 307, and the electrode portions 306), the back surface layer 2 (the overcoat glass 303), the sliding surface layer 1 (the base layer 304), and the sliding surface layer 2 (the overcoat glass 305). When there are a plurality of materials, layers are formed in an order of the materials shown in the parentheses. In other words, in the present embodiment, a process for forming the sliding surface layer 1 (the base layer 304) as a shape-imparting layer that imparts a desired shape (the glass peak portion P) to the overcoat glass 305 is provided before a process for forming the sliding surface layer 2 (the overcoat glass 305).

Step 3

Substrates 301 are divided along the scribe lines from the mother plate M to obtain the heaters 300 ($L_1$ to $L_8$). In other words, in the present embodiment, positional accuracy when forming scribe lines and positional accuracy when performing screen printing with respect to the mother plate M are managed and the substrates 301 are subsequently divided. Accordingly, heaters can be manufactured more efficiently as compared to managing positional accuracy and performing screen printing for each substrate 301 after dividing the substrates 301. It should be kept in mind that forming an overcoat glass so as to cover the scribe lines diminishes mass productivity due to the overcoat glass preventing substrates from being divided and causing shape defects to occur.

sectional view of a periphery of the glass peak portion P on the downstream side of the heater 300 in a case where the glass content of the base layer 304 is set to 15 weight percent. Since a shape of the upstream side is symmetrical to that of the downstream side, an illustration thereof will be omitted.

Figure 5A:
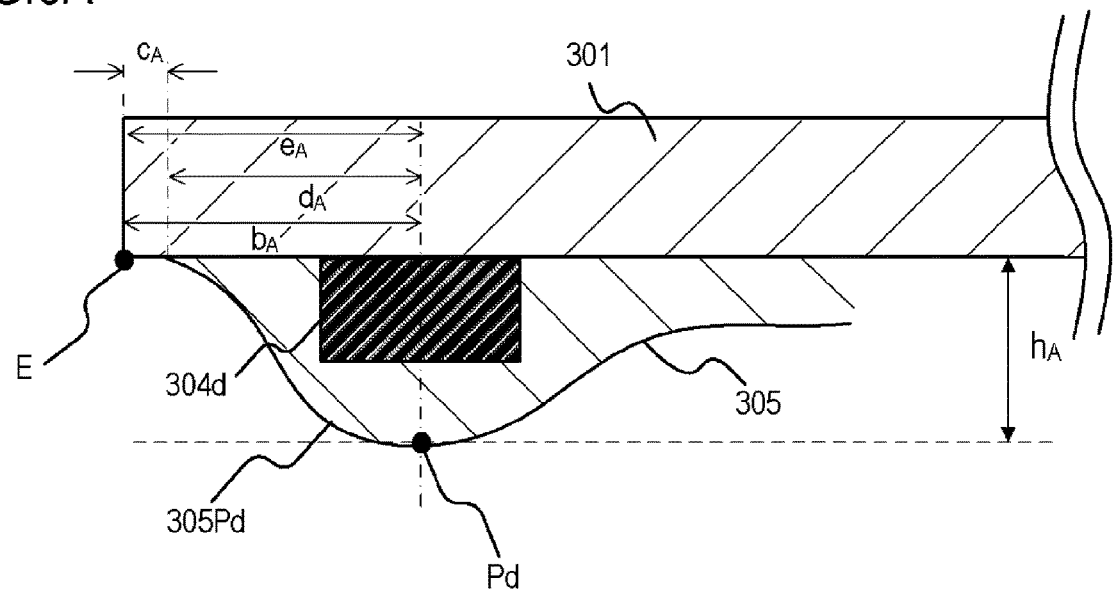
FIGS. 5A and 5B are sectional views of a periphery of a glass peak portion P.
Figure 5B:
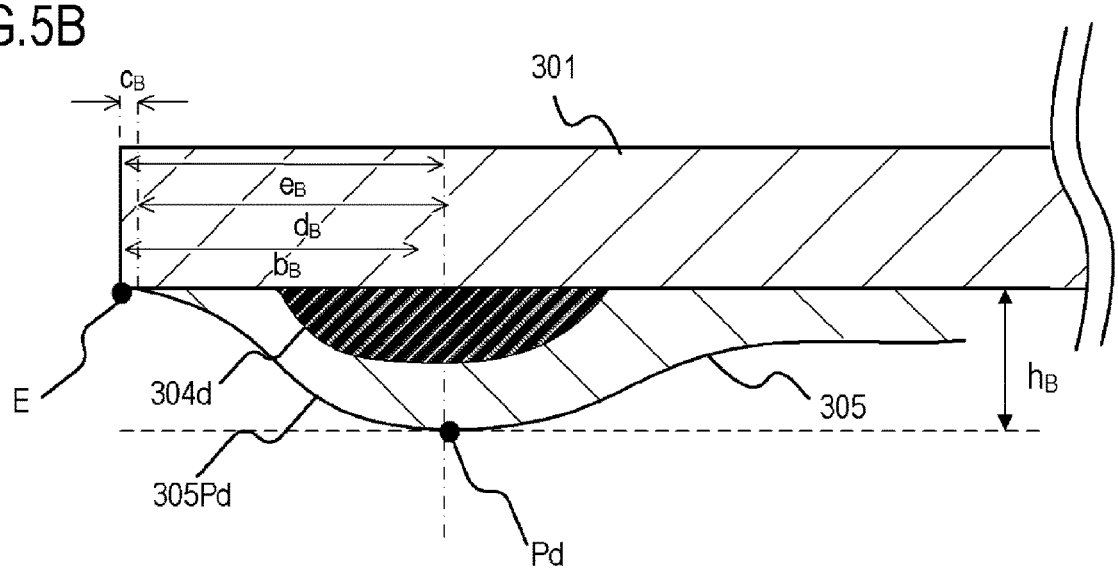

Table 1 presents a list of key parameters in FIGS. 5A and 5B. In this case, each key parameter was measured using a wide-area 3D measurement system manufactured by KEYENCE CORPORATION by arranging the sliding surface side of the heater 300 in front of the measurement system. Measurements were performed under conditions of ISO4287: 1997 (JIS B0601: 2001) by setting cutoff wavelengths to $\lambda c$=0.25 mm and $\lambda f$=8 mm, a measurement type to waviness, a reference wavelength to 1, and tilt correction to not applicable.

The glass peak portion P is a maximal portion of the overcoat glass 305 formed by the base layer 304, and when the overcoat glass 305 has a plurality of peaks, the peak nearest to an end in the transverse direction is adopted as the glass peak portion P. In addition, as a premise, the width of the base layer 304 in the transverse direction is 0.5 mm, and a same condition of the distance b between the center position of the base layer 304 and the heater edge E during screen printing and before the baking process was applied to both FIGS. 5A and 5B ($b_A$=$b_B$).

TABLE 1

List of numerical values of key parameters in FIGS. 5A and 5B

| | Height h of glass peak portion P | Distance b between base layer and heater edge | Distance c between heater edge and glass-forming region | Distance d between end of glass-forming region and glass peak portion | Distance e (=c + d) between glass peak portion P and heater edge | Glass steepness G (=h/d) |
|---|---|---|---|---|---|---|
| FIG. 5A | 0.035 mm | 1.0 mm | 0.2 mm | 0.8 mm | 1.0 mm | 0.04 |
| FIG. 5B | 0.020 mm | 1.0 mm | 0.1 mm | 1.1 mm | 1.2 mm | 0.02 |

The glass peak portion P that is a feature of the present embodiment will now be described in detail.

The glass peak portion P can be formed in a steep shape by forming the overcoat glass 305 on the base layer 304. In other words, the overcoat glass 305 is to be formed in a desired shape by the base layer 304 as a shape-imparting portion. Although the base layer 304 and the overcoat glass 305 are formed in single configurations along the longitudinal direction of the substrate 301 in the present embodiment, alternatively, configurations may be adopted in which the base layer 304 and the overcoat glass 305 are intermittently divided into a plurality of sections along the longitudinal direction. In other words, various configurations may be adopted as long as the configurations enable rubbing between the inner surface of the film 21 and the heater edge E of the substrate 301 to be suitably suppressed.

In this case, a content of glass in the base layer 304 is 1.0 weight percent (wt %). Regarding glass to be contained in the base layer 304, although an infinitesimal amount of glass is required for the purpose of binding the base layer 304 with the vitreous overcoat glass 305, minimizing the glass content enables the glass peak portion P to be formed in a steeper shape.

FIG. 5A shows a schematic sectional view of a periphery of the glass peak portion P on the downstream side of the heater 300 in a case where the glass content of the base layer 304 is set to 1.0 weight percent (the present embodiment). As a comparative example, FIG. 5B shows a schematic The height of the glass peak portion P is higher ($h_A$>$h_B$) and the glass peak portion P is nearer to the heater edge E ($e_A$<$e_B$) in the case of FIG. 5A where the glass content of the base layer is low as compared to the case of FIG. 5B where the glass content of the base layer is high. In other words, it is shown that the glass peak portion P is formed steeper in the case of FIG. 5A where the glass content of the base layer is low. This is because the lower the glass content of the base layer 304 which is a base of the glass peak portion P, the greater the ability of the base layer 304 to maintain its shape after baking.

For example, a relationship between the distance b between the heater edge E and the center position of the base layer 304 (during screen printing) and a distance e between the heater edge E and the glass peak portion P is expressed as b=e under the conditions of FIG. 5A because the base layer is capable of maintaining its shape prior to baking. On the other hand, the relationship is expressed as b<e under the condition of FIG. 5B because the base layer is incapable of maintaining its shape prior to baking and melts and spreads. As a result, adopting the conditions of FIG. 5A after forming the overcoat glass 305 enables the glass peak portion P to be kept in a steeper shape as compared to adopting the conditions of FIG. 5B after forming the overcoat glass 305. In the present embodiment, abrasion of the inner surface of the film by the heater edge E can be suppressed when the distance from the heater edge E to the glass peak portion P is less than 1.0 mm. It should be noted that a suitable distance from the heater edge E to the glass peak portion P is to be appropriately set in accordance with apparatus configuration and is not limited to less than 1.0 mm.

An indicator of a degree of a steep gradient of the glass peak portion P can be expressed as a glass steepness G (G=h/d), where d denotes a width in the transverse direction of a region covered by the glass 305 between the glass peak portion P and a side of the heater edge E.

Figure 6:
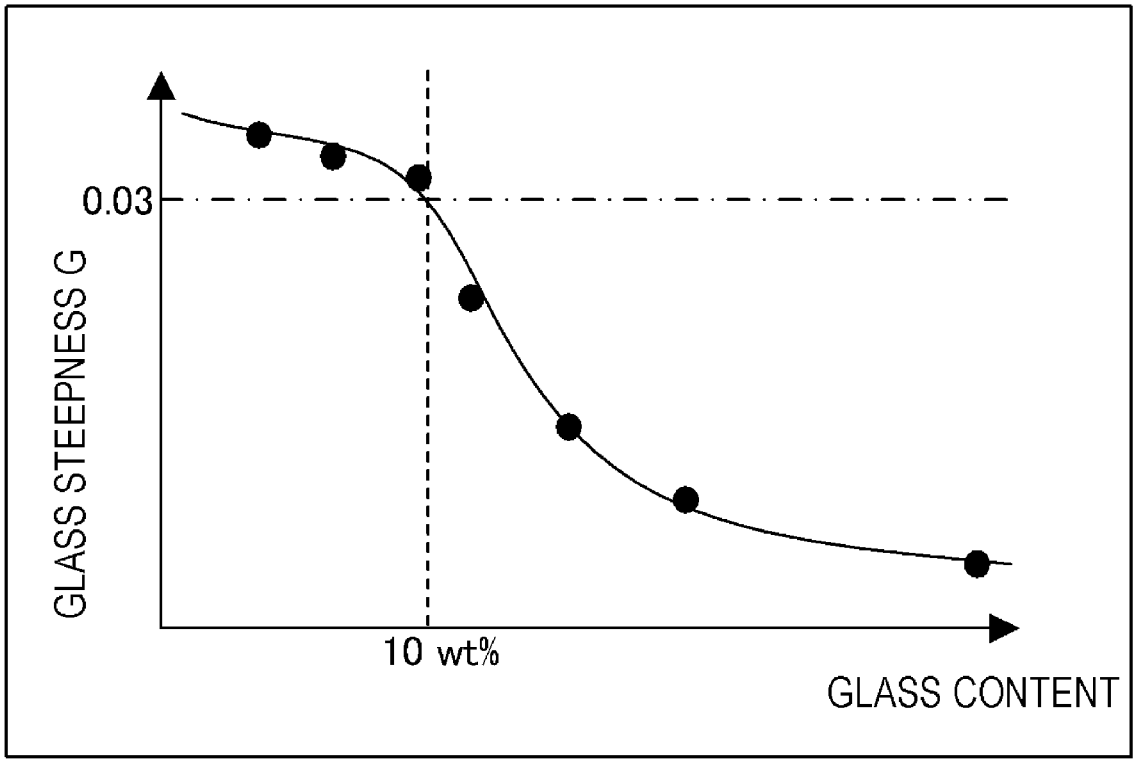
FIG. 6 is a graph showing a relationship between a glass steepness G and a base layer glass content.

FIG. 6 presents a relationship between the glass steepness G and a glass content of the base layer 304. In the present embodiment, as a rough guide, having a glass steepness G of 0.03 or higher enables inner surface abrasion of the film 21 by the heater edge E to be suppressed. In this case, a distance (a glass gap) c from the heater edge E to the region covered by the glass 305 was 0.2 mm. It should be noted that suitable numerical values of the glass steepness G and the glass gap c are to be appropriately set in accordance with apparatus configuration and are not limited to the numerical values described herein.

TABLE 2

| Film inner surface abrasion/image heating apparatus quick-starting ability/mass productivity | | | | | |
|---|---|---|---|---|---|
| | Glass steepness G | Glass gap c | Film inner surface abrasion | Image heating apparatus quick-starting ability | Mass productivity |
| (A) First embodiment: Steep glass peak portion, Glass thickness 30 μm | 0.04 | 0.2 mm | ○Favorable | ○Favorable | ○Favorable |
| (B) First comparative example: Gradual glass peak portion, Glass thickness 30 μm | 0.02 | 0.2 mm | XPoor | ○Favorable | ○Favorable |
| (C) Second comparative example: No glass peak portion, Glass thickness 60 μm | 0.02 | 0.2 mm | XPoor | XPoor | ○Favorable |
| (D) Third comparative example: No glass peak portion, Glass thickness 60 μm | 0.005 | 0.2 mm | XPoor | ○Favorable | ○Favorable |
| (E) Fourth comparative example: No glass peak portion, Glass thickness 60 μm, Heater edge protected | 0.005 | None | ○Favorable | ○Favorable | XPoor |

Table 2 represents a comparison among cases where different heaters are mounted to the heating apparatus 10 according to the present embodiment with respect to an inner surface abrasion of the film 21 due to rubbing between the film 21 and the heater edge E, quick-starting ability of the heating apparatus due to heat conductance between the heater and the film 21, and mass productivity. As a premise, the glass gap c in (A) to (D) which take mass productivity into consideration was set to 0.2 mm.

Figure 7A:
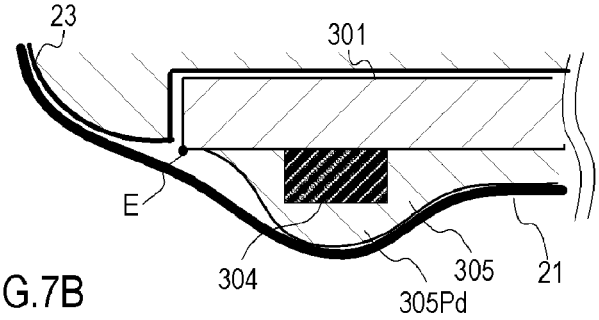
FIGS. 7A to 7E are schematic views (the first embodiment) showing a relationship between a glass shape and a trajectory of a film.

(A) With the heater 300 used in the present embodiment, since the glass steepness of the glass peak portion P can be increased and a thin overcoat glass of 30 μm can be formed as described above, favorable quick-starting ability of the heating apparatus can be obtained (FIG. 7A).

Figure 7B:
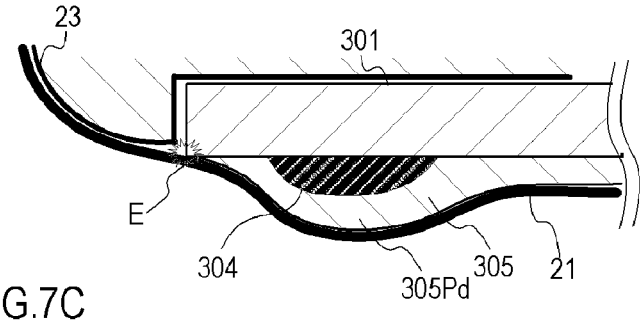

(B) With the heater according to the first comparative example, although the glass peak portion P can be formed P as described above, the glass steepness G decreases due to the effect of the base layer and film inner surface abrasion could not be suppressed (FIG. 7B).

Figure 7C:
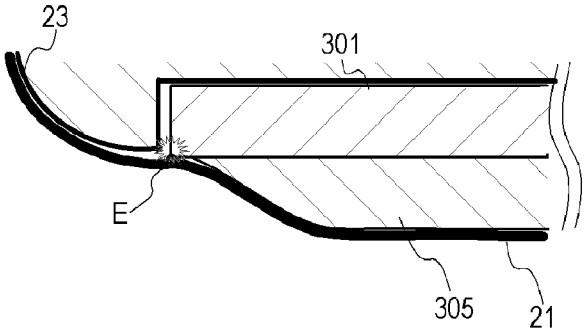
Figure 7D:
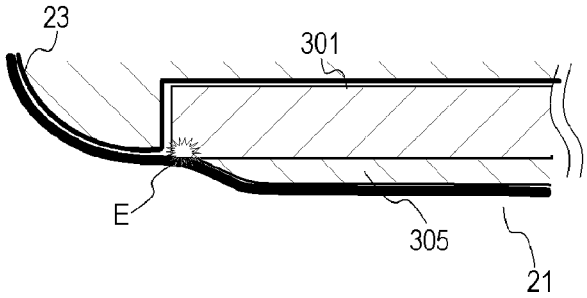

(C) The heater according to the second comparative example represents a case where a base layer that forms a glass peak portion was not formed but glass with a large thickness (60 μm) was formed. The thickness of the glass 305 caused leveling to occur during baking, and since a steep shape from a substrate end could not be maintained, glass steepness was low and inner surface abrasion could not be suppressed (FIG. 7C). In addition, the thickness of the glass diminished the quick-starting ability of the heating apparatus.

(D) The heater according to the third comparative example represents a case where a base layer that forms a glass peak portion was not formed but glass with a small thickness (30 μm) was formed. While the quick-starting ability of the image heating apparatus is favorable, a state of the film inner surface abrasion is poor due to the absence of glass peak portions and the small glass thickness.

Figure 7E:
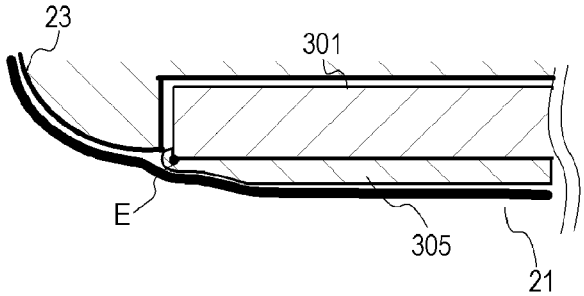

(E) The heater according to the fourth comparative example represents a case where a ridge portion of the heater edge is coated with glass. Although a state of the film inner surface abrasion is favorable and the quick-starting ability of the heating apparatus is also favorable regardless of the glass steepness, it is difficult to divide the substrates from the mother plate and mass productivity becomes an issue (FIG. 7E).

As described above, according to the present embodiment, by forming a vitreous overcoat layer after forming a base layer with a glass content of 10 wt % or lower along a longitudinal direction, a steep glass peak portion can be formed on a heater substrate of a heating apparatus and on a sliding surface side in a vicinity of an end of the heater substrate. It should be noted that a suitable glass content in the base layer is to be appropriately set in accordance with apparatus configuration and is not limited to the numerical value described herein. Using a heater and a heating apparatus configured as described in the present embodiment enables damage to film due to rubbing between a film inner surface and a heater edge to be suppressed without diminishing mass productivity. In addition, since a position in the transverse direction of the glass peak portion on the sliding surface side is set so as to differ from that of the heating element on the back surface side, favorable heat conductance between the film and the heater is realized and the heating apparatus can perform a quick start. In other words, a heater having a steep glass peak portion capable of suppressing inner surface abrasion of the film due to the heater edge without inhibiting heat conductance by the heating element and without complicating a manufacturing process can be obtained.

Furthermore, while a contactless wide-area 3D measurement system manufactured by KEYENCE CORPORATION was used as a measuring instrument for measuring a surface profile of the heater 300, there are cases where, depending on a type of the overcoat glass, transmission through the glass prevents the surface profile from being accurately measured. In such a case, a contact-type surface roughness measuring instrument (for example, SURFCOM 1500SD manufactured by TOKYO SEIMITSU CO., LTD.) may be used.

In addition, in the present embodiment, while the glass peak portion on the sliding surface side is only formed at an end in the transverse direction, the glass peak portion at the substrate end has a similar effect even when peaks are present at other locations in the transverse direction in addition to the end.

Figure 8:
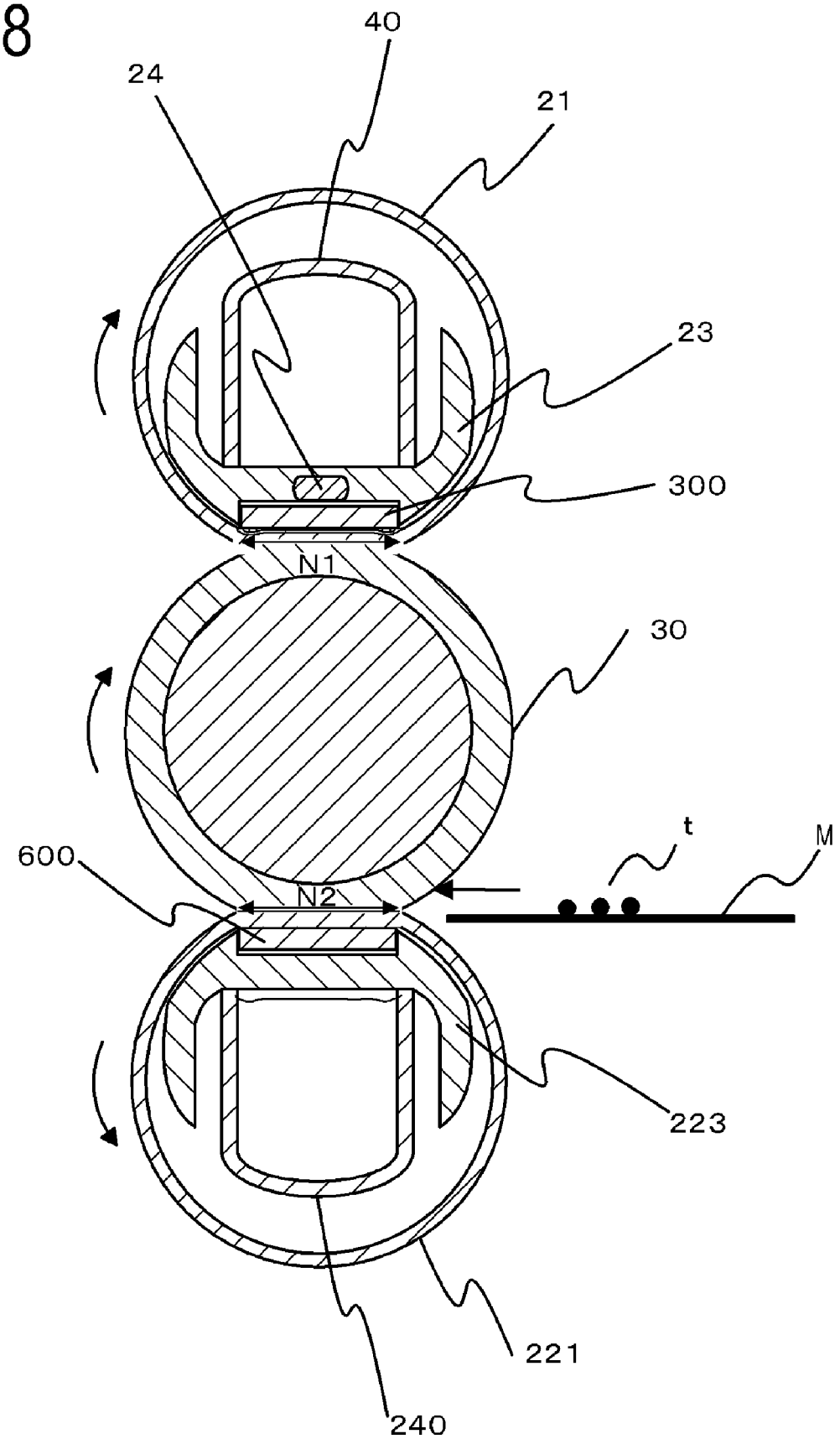
FIG. 8 represents a modification of an image heating apparatus according to the first embodiment.
Figure 9A:
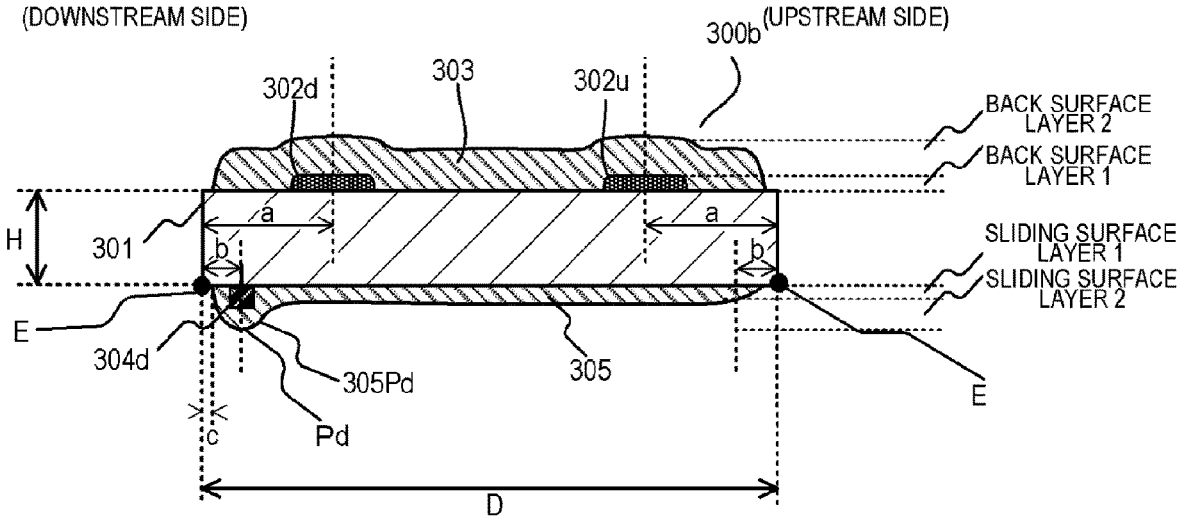
FIGS. 9A to 9E are schematic views showing a shape of a heater according to a second embodiment.
Figure 9B:
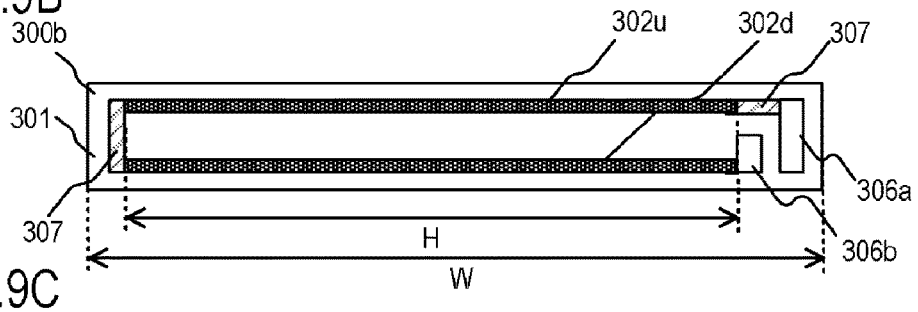
Figure 9C:
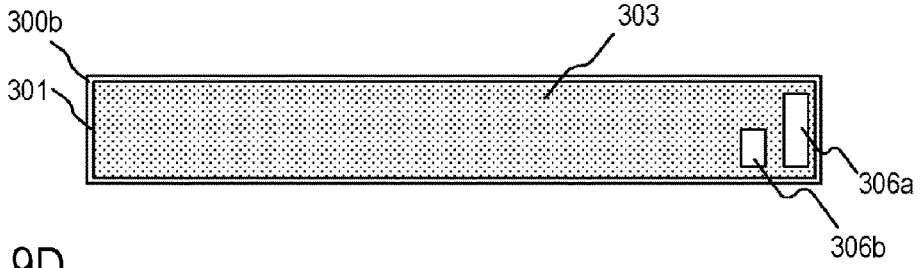
Figure 9D:
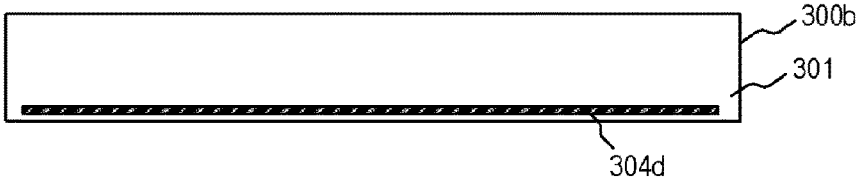
Figure 9E:
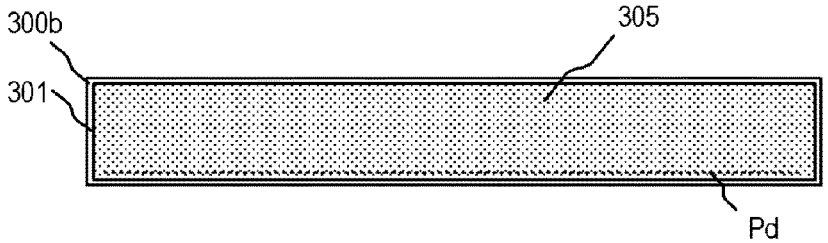

FIG. 8 is a schematic configuration diagram showing a schematic configuration of an image heating apparatus according a modification of the present embodiment. While a heating apparatus which heats and melts toner in a fixing nip portion formed by a film as an endless belt with a built-in heater and a pressure roller as a pressure rotating member has been described in the present embodiment, a heating apparatus configured as shown in FIG. 8 may be adopted instead. Specifically, first, in a nip portion N1 formed by the film 21 with a built-in heater 300 and the roller 30, heat of the heater 300 is transferred to the roller 30. Subsequently, toner is heated and melted in a fixing nip portion N2 formed by the roller 30 and a film 221 as a second endless belt. The fixing nip portion N2 is formed by imparting spring pressure (not illustrated) from a stay 240 via a film guide 223 which guides the film 221 with respect to a pressing plate 600 and which supports the pressing plate 600. Even in such a configuration, providing a glass peak portion P on a film sliding surface of the heater 300 enables a similar effect to the first embodiment to be produced.

Second Embodiment

The second embodiment of the present invention will be described. A shape of a heater 300*b* and a shape of the film guide 23 according to the second embodiment differ from those of the first embodiment. Otherwise, the configuration is similar to that of the first embodiment and a description thereof will be omitted.

FIGS. 9A to 9E are schematic views showing a shape of the heater 300*b* according to the second embodiment. The heater 300*b* according to the present embodiment differs from the first embodiment in a shape of the overcoat glass 305. In the present embodiment, the base layer 304 is only provided on a downstream side (304*d*) and, therefore, the glass peak portion P created by the overcoat glass 305 is also only present on the downstream side (Pd).

Figure 10A:
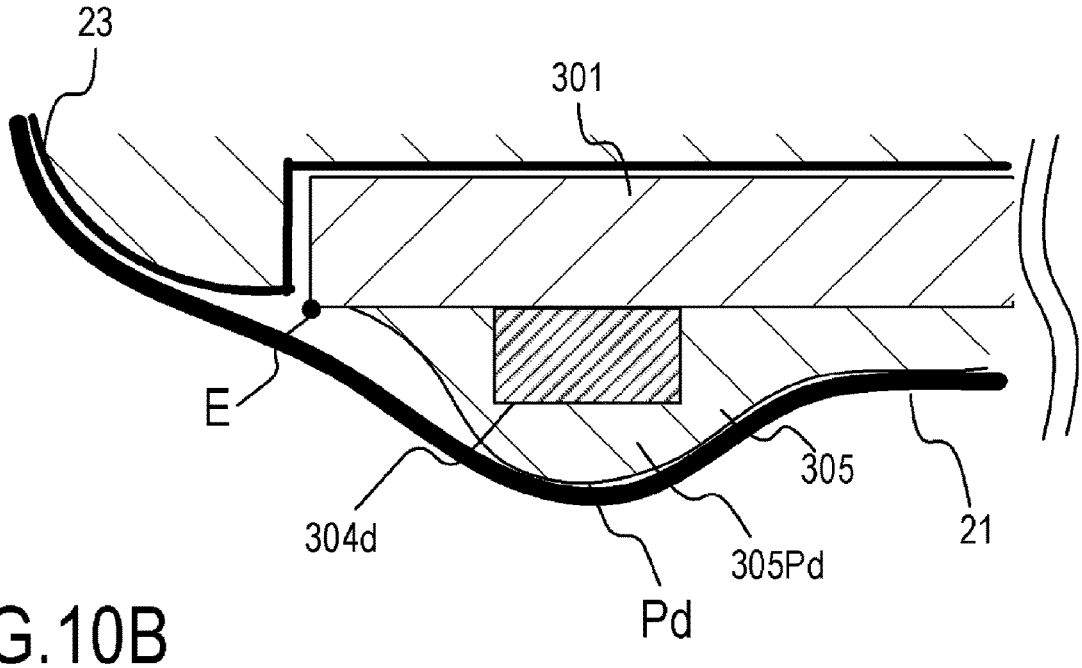
FIGS. 10A and 10B are schematic views (the second embodiment) showing a relationship between a glass shape and a trajectory of a film.
Figure 10B:
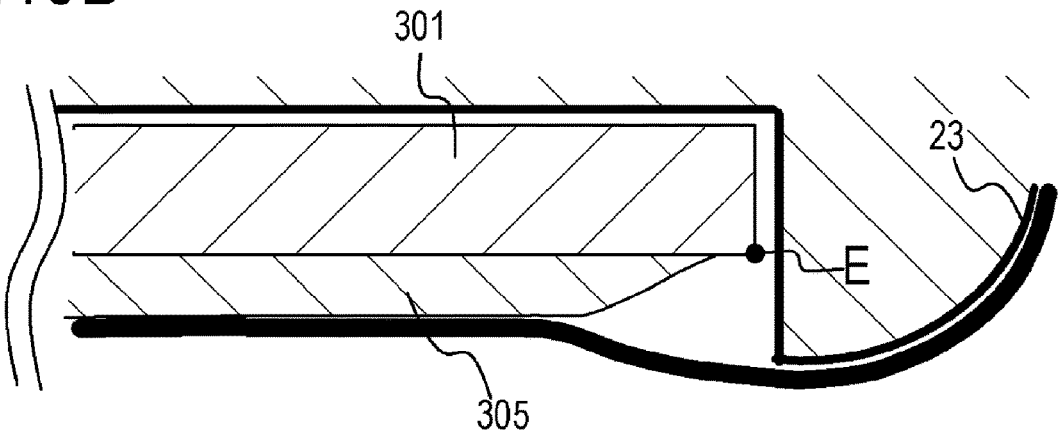
Figure 11A:
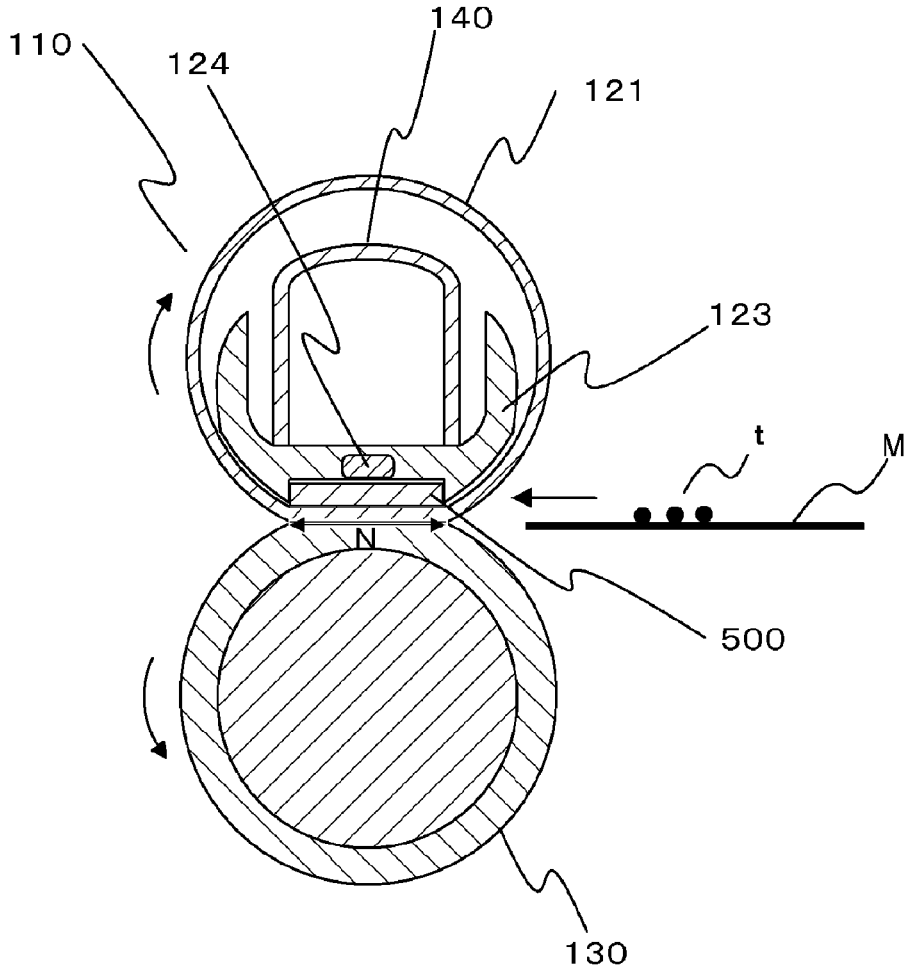
FIGS. 11A and 11B are schematic sectional views of a conventional image heating apparatus adopting a film heating system.
Figure 11B:
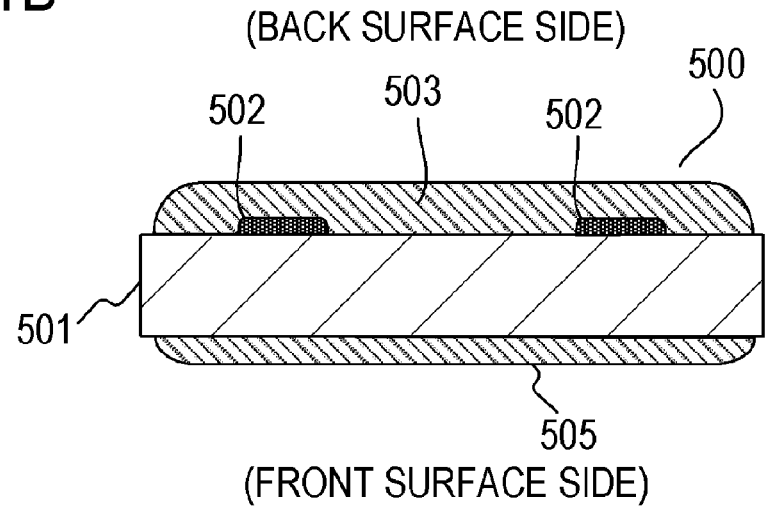

FIGS. 10A and 10B are configuration diagrams showing a relationship between the film guide 23 and the heater 300 according to the present embodiment. As shown in FIG. 10A, the relationship between the film guide 23 on the downstream side of the fixing nip portion N and the heater 300 is similar to that of the first embodiment. However, in the relationship of the upstream side shown in FIG. 10B, the film guide 23 has a more convex shape than the heater 300 and rubbing between the upstream-side film 21 and the heater edge E is protected by the film guide 23.

A suitable configuration in terms of forming a glass peak portion only on one side of a substrate or on both sides of the substrate may be selected in accordance with a configuration of the fixing nip portion, rigidity of the film, and the like.

Configurations of the respective embodiments and the modification described above can be mutually combined to the greatest extent feasible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-154609, filed on Aug. 21, 2018, which is hereby incorporated by reference herein in its entirety.

What is claimed is:

1. A heater being used in an image heating apparatus which heats an image formed on a recording material, comprising:

a substrate;

a heating element provided on one surface of the substrate; and a glass layer formed on the other surface of the substrate opposite from the one surface, wherein the glass layer has a protruding portion that protrudes further than an end of the substrate in a transverse direction that is orthogonal to a longitudinal direction of the substrate, and wherein the protruding portion has a maximum height from the other surface at a position closer to an end side of the substrate than a center position of the heating element in the transverse direction.

2. The heater according to claim 1, wherein the heater has a base layer formed so as to extend along a longitudinal direction of the substrate between the other surface and the glass layer and at a position closer to an end side of the substrate than a center position of the heating element in a transverse direction that is orthogonal to the longitudinal direction of the substrate, wherein the glass layer is provided for protecting the base layer, wherein the base layer has a glass content of 10 wt % or lower, and wherein the protruding portion is formed in a portion that covers the base layer in the glass layer.

3. The heater according to claim 1, wherein a peak portion with a maximum height from the other surface in the protruding portion is positioned within 1.0 mm from the end in the transverse direction.

4. The heater according to claim 1, wherein the protruding portion is provided on the the glass layer at least in a position close to one end side of the substrate in a transverse direction.

5. The heater according to claim 1, wherein the protruding portion is formed so as to extend along a longitudinal direction of the substrate.

6. A heater being used in an image heating apparatus which heats an image formed on a recording material, comprising:

a substrate;

a heating element provided on one surface of the substrate; and a glass layer formed on the other surface of the substrate opposite from the one surface, wherein the heater has a base layer formed so as to extend along a longitudinal direction of the substrate between the other surface and the glass layer and at a position closer to an end side of the substrate than a center position of the heating element in a transverse direction that is orthogonal to the longitudinal direction of the substrate, wherein the glass layer is provided for protecting the base layer, wherein the base layer has a glass content of 10 wt % or lower, and wherein a peak portion with a peak height from the other surface in the glass layer is positioned within 1.0 mm from an end in the transverse direction of the substrate.

7. The heater according to claim 6, wherein the peak portion is formed at least on one end side of the glass layer in the transverse direction.

8. The heater according to claim 6, wherein a gradient of the peak portion from an end of an end side of the substrate in the glass layer is 0.03 or more.

9. The heater according to claim 6, wherein the glass layer is formed so as to avoid a vicinity of an end edge in the transverse direction of the other surface.

10. The heater according to claim 6, wherein the base layer contains silver or a silver-palladium alloy.

11. The heater according to claim 6, wherein the base layer is a shape-imparting portion for forming the peak portion in the glass layer.

12. An image heating apparatus, comprising:

the heater according to claim 6;

a cylindrical film having an inner surface with which the heater comes into contact;

a film guide portion which guides the inner surface of the film; and a rotating member which comes into contact with an outer surface of the film so as to form a nip portion for sandwiching and transporting a recording material between the outer surface of the film and the rotating member, wherein the apparatus heats an image formed on the recording material using heat of the heater.

13. The image heating apparatus according to claim 12, wherein the film guide portion is configured such that, on an upstream side of a transportation direction of the recording material of the heater, a height from the other surface is higher than the glass layer.

14. The image heating apparatus according to claim 12, wherein the glass layer has a protruding portion that protrudes toward the inner surface of the film, and supports the inner surface of the film together with the film guide portion, the film guide portion positioned on an opposite side with respect to an end in the transverse direction of the substrate.

15. The image heating apparatus according to claim 14, wherein the protruding portion supports the inner surface of the film together with the film guide portion so as to suppress sliding contact between the end of the substrate and the inner surface of the film.

16. An image forming apparatus, comprising:

an image forming portion which forms an image on a recording material; and a fixing portion which fixes an image formed on the recording material to the recording material, wherein the fixing portion is the image heating apparatus according to claim 12.

* * * * *